United States Patent [19]

Tokura et al.

[11] 3,965,913

[45] June 29, 1976

[54] CASH DISPENSING SYSTEM

[75] Inventors: Katsuyuki Tokura, Kawasaki; Shuichi Maeda, Inagi; Takeshi Endo, Yokohama; Kenji Yoichizono, Mitaka; Hiroshi Asami, Inagi, all of Japan

[73] Assignee: Fujitsu Ltd., Kawasaki, Japan

[22] Filed: Feb. 8, 1974

[21] Appl. No.: 440,659

[30] Foreign Application Priority Data

Feb. 19, 1973 Japan ..... 48-20489

[52] U.S. Cl. ..... 133/8 R

[51] Int. Cl.[2] ..... B65H 29/14

[58] Field of Search ..... 194/DIG. 9 B, 4 R; 221/21; 133/1, 4 R, 5 R; 235/92 SB, 92 QC

[56] References Cited

UNITED STATES PATENTS

| | | | |
|---|---|---|---|
| 3,443,675 | 5/1969 | Yamamoto et al. | 194/4 R |
| 3,447,655 | 6/1969 | Tanaka | 194/DIG. 9 |
| 3,701,523 | 10/1972 | Erickson | 194/DIG. 9 |
| 3,779,440 | 12/1973 | Casale | 235/92 SB |
| 3,807,417 | 4/1974 | Shigemori | 194/DIG. 9 |

*Primary Examiner*—Stanley H. Tollberg
*Attorney, Agent, or Firm*—Staas & Halsey

[57] ABSTRACT

A cash dispensing system capable of automatically counting and dispensing cash of the amount requested by a customer to be withdrawn is disclosed. Where an error occurs in a cash dispensing process, cash dispensing is stopped and the cash dispensing operation is repeated from the beginning. Where the error occurs a predetermined number of times, the cash dispensing operation is entirely stopped.

21 Claims, 10 Drawing Figures

FIG. 7
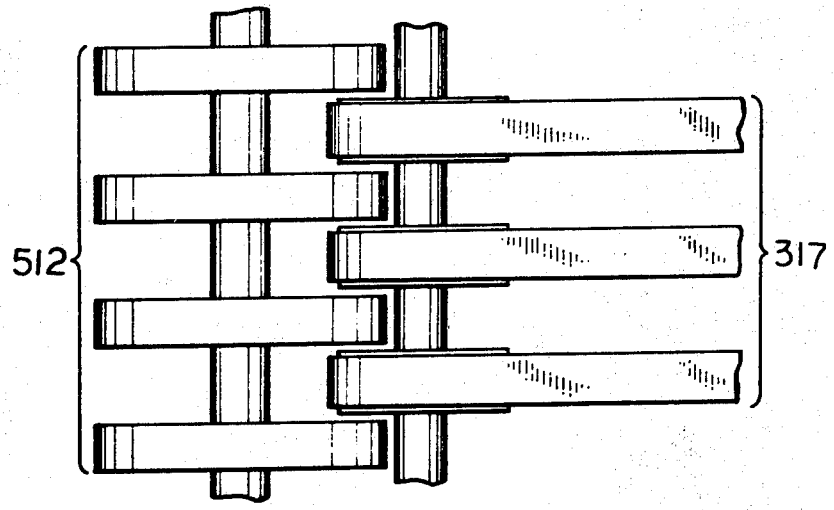
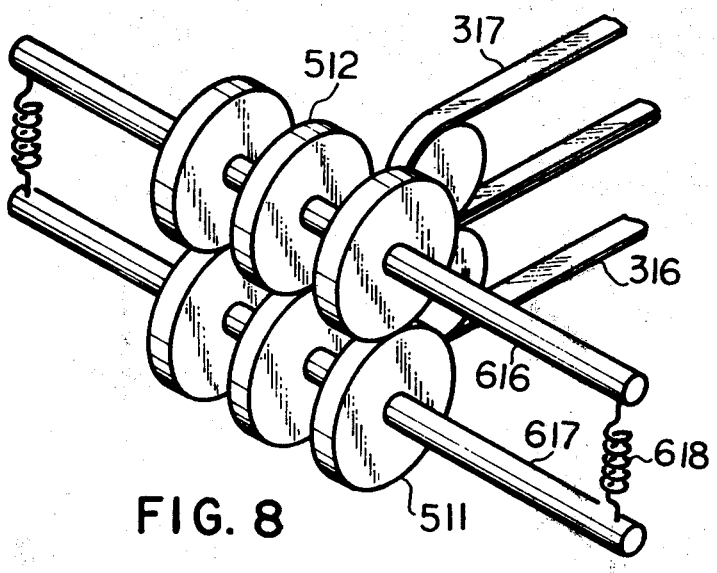
FIG. 8

CASH DISPENSING SYSTEM

BACKGROUND OF THE INVENTION

1. Field of the Invention

This invention relates to a cash dispensing system capable of automatically counting and dispensing cash of the amount requested by a customer to be withdrawn and, more particularly, to a system and apparatus for detecting when an error occurs in a cash dispensing process for controlling further dispensing operations.

2. Description of the Prior Art

The recent spread of labor-saving machines is striking and even an unmanned factory is also being planned. Such labor-saving machines have entered into the fields of banks and like establishments and an automatic cash dispenser capable of automatic cash dispensing is now being widely spread.

With such an automatic cash dispenser, a customer can receive a desired amount of money by inserting into the machine a card having recorded thereon his account number (or identification number), a deposited amount of money (or an amount of money to be paid), etc. and by entering an amount of money desired to be withdrawn. Therefore, this automatic cash dispenser saves time and labor for cash dispensing business and enables the banks to offer 24-hour business service and to be unmanned. The prior art of the cash dispensing machine is shown, for example in, the U.S. Pat. Nos. 3,560,715, 3,575,271, 3,641,497 and 3,651,986. In the automatic cash dispensing machine of the above operation, transactions with customers are based on credit, so that it is absolutely necessary to avoid an erroneous operation of the machine, especially an error in counting the amount of money requested by a customer to be withdrawn. To this end, in the automatic cash dispensing machine, a cash counting section takes out bills from a cash container and detects the thickness, length, etc. of each bill and then dispenses the bills one by one. By such detection, abnormality of some extent can be processed on the side of the cash counting section but, in the case of other abnormality, the machine is stopped. Such stoppage of the machine assures that cash erroneously counted is not paid to the customer but repeated stoppage of the machine leads to discredit, which is likely to discredit the bank with customers. Further, for releasing the machine from its stopped condition, an operator or like hand is required and this offsets the advantage of labor saving which is obtainable with this kind of machine. Therefore, in the automatic dispensing machine of this type, it is necessary to avoid stoppage of the machine as much as possible. Where the machine is stopped by some cause, re-actuation of the cash counter leads to the normal cash dispensing operation in many cases. Namely, close contact of bills, erroneous counting of bill or the like is not always caused by a trouble of the machine itself but by the state of bills.

SUMMARY OF THE INVENTION

This invention is to provide a cash dispensing system which overcomes the aforesaid defects experienced in the prior art and does not stop the operation of the machine simultaneously with detection of abnormality.

Accordingly, in this invention, where abnormality occurs in the cash counting section, the machine is not stopped but, instead, cash taken out from the cash container is collected and the cash counting operation is performed again. In this case, re-counting is not limited to once but may be achieved a desired number of times and the machine is stopped only where abnormality still occurs even after re-counting has been achieved a predetermined number of times.

This prevents customers from having a distrust of the automatic cash dispensing machine without reason and does not frequently require an operator or the like. Consequently, labor saving which is the primary object of the machine can be well accomplished and the efficiency of utilization of the machine can also be enhanced.

Further, it is one of the objects of this invention to provide means which is effective for solving various problems resulting from the use of belts which are employed for carrying cash in a desired direction at high speed.

With the present invention, in the case of employing such an arrangement that cash is brought by means of belts, it is easy to effect cash rejection in the case of occurrence of abnormality. Further, it is also possible to present cash, for example, bills before a customer in such a manner that the bills may not be blown away by the wind and that the customer may take out the bills with one action. Moreover, it is also possible to put bills in order on its way to a cash dispensing outlet to ensure that bills are all presented before the customer.

BRIEF DESCRIPTION OF THE DRAWINGS

In the detailed description of the preferred embodiments of the invention presented below, reference is made to the accompanying drawings, in which:

FIG. 5 is a schematic diagram, for explaining a cash transfer path in the case where a cash dispenser is embedded in the wall of a building or the like;

FIG. 7 is a plan view of the neighborhood of a clamping roller depicted in FIG. 6;

FIG. 8 is a perspective view of the same part as that shown in FIG. 7;

DESCRIPTION OF THE PREFERRED EMBODIMENTS

Figure 1:
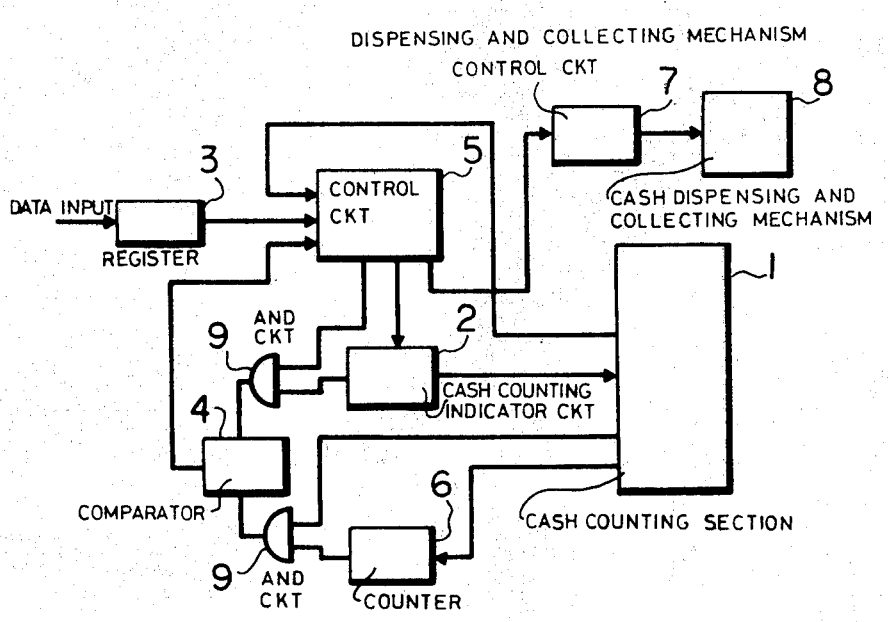
FIG. 1 is a block diagram showing one example of apparatus embodying this invention.

FIG. 1 shows in block form one example of apparatus embodying this invention.

In FIG. 1, reference numeral 1 indicates a cash counting section; 2 designates a cash counting indicator circuit; 3 indentifies a register; 4 represents a comparator; 5 denotes a control circuit; 6 shows a counter; 7 refers to a cash dispensing and collecting mechanism control circuit; 8 designates a cash dispensing and collecting mechanism; and 9 indicates AND circuits.

The operation of the apparatus of FIG. 1 will hereinbelow be outlined.

At first, a data signal indicative of the amount of money requested to be withdrawn is introduced into the apparatus from the outside thereof and is stored in the register 3. The data signal stored in the register 3 is applied to the control circuit 5. In accordance with the data signal, the control circuit 5 causes the cash counting indicator circuit 2 to produce a signal indicative of the number of bills to be paid, which signal is applied to the cash counting section 1.

The cash counting section 1 applies a pulse to the counter 6 at every detection of each bill. Having completed counting of the bills corresponding to the signal indicative of the number of bills to be paid, the cash counting section 1 produces a counting termination signal, whereby and the AND gate circuit 9 is opened. The cash counting section 1 performs not only counting of the number of bills but also checking the length, thickness, light transmission factor and the like of the bill. If abnormality is found, the cash counting section 1 immediately applies an abnormality signal to the control circuit 5.

Upon opening of the AND circuit 9, the count content of the counter 6 is supplied to the comparator circuit 4. In the comparator circuit 4, the count content of the counter 6 is compared with the signal indicative of the number of bills to be paid which is applied to the comparator circuit 4 from the cash counting indicator circuit 2 through the AND circuit 9 which is opened by a signal derived from the control circuit 5. The resulting comparison signal derived from the comparator circuit 4 is applied to the control circuit 5.

Upon arrival of a coincidence signal from the comparator circuit 4, the control circuit 5 supplies the cash dispensing and collecting mechanism control circuit 7 with a cash dispensing signal. When supplied with a non-coincidence signal from the comparator circuit 4, the control circuit 5 applies a cash collecting signal to the cash dispensing and collecting mechanism control circuit 7. Further, it is a matter of course that, also when supplied with the abnormality signal from the cash counting section 1 as referred to above, the control circuit 5 applies a cash collecting signal to the cash dispensing and collecting mechanism control circuit 7.

In accordance with the cash dispensing signal from the control circuit 5, the cash dispensing and collecting mechanism control circuit 7 causes the cash dispensing and collecting mechanism 8 to perform a cash dispensing operation, that is, an operation for having a customer receive cash. Further, when supplied with the cash collecting signal from the control circuit 5, the circuit 7 causes the cash dispensing and collecting mechanism 8 to achieve a cash collecting operation.

Upon completion of the cash collecting operation by the cash dispensing and collecting mechanism 8, the control circuit 5 again applies a signal to the counting indicator circuit 2 to actuate the cash counting section 1 to repeat the aforesaid cash dispensing operation.

In the case of having repeated the cash dispensing operation, when no abnormality is found, cash is dispensed. However, where the aforementioned non-coincidence signal or abnormality signal is still produced even after the cash dispensing operation is achieved a predetermined number of times, the operation of the whole apparatus is stopped and a warning indication is provided or a warning signal is sent out.

Repetition of the cash dispensing operation such as described above is entirely under the control of the control circuit 5. The cash dispensing operation is not carried out when a trouble such, for example, blowing of a fuse, occurs in the apparatus and the operation is achieved only when minor abnormality such as an error in cash counting, an erroneous circuit operation or the like, occurs.

Figure 2:
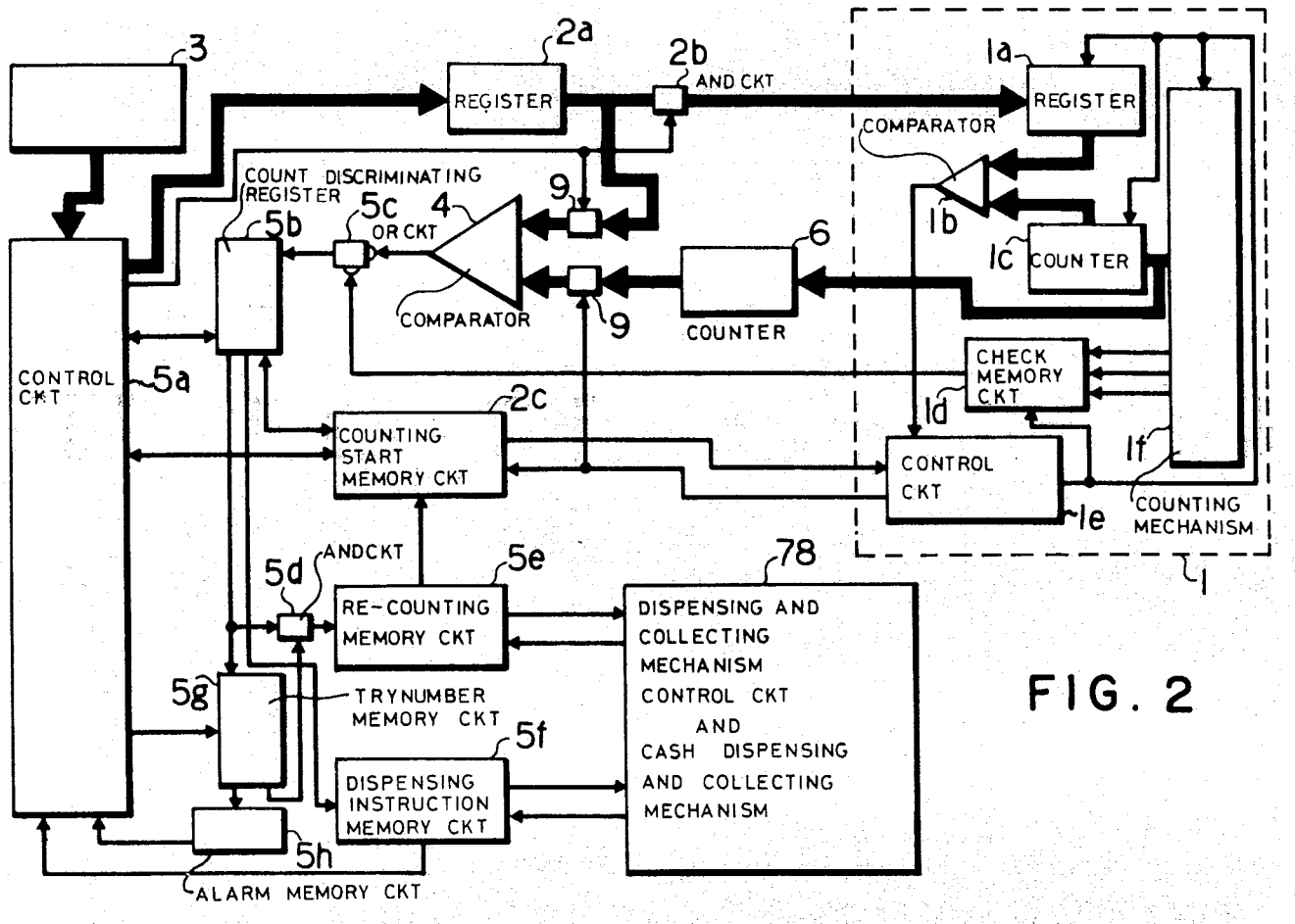
FIG. 2 is a block diagram showing more in detail the apparatus depicted in FIG. 1.

Turning now to FIG. 2, a detailed description will be given of the apparatus described above with regard to FIG. 1. In FIG. 2, thick lines are data lines and the other, thin lines are control lines.

On the cash counting section 1:

this section includes a register 1*a*, a comparator 1*b*, a counter 1*c*, a check memory circuit 1*d*, a control circuit 1*e* and a counting mechanism 1*f*.

On the cash counting indicator circuit 2:

this circuit includes a register 2*a*, and AND circuit 2*b* and a counting start memory circuit 2*c*.

On the register 3:

this is identified by 3 in FIG. 2, too, and, in practice, this is the so-called buffer memory circuit.

On the comparator circuit 4:

this is also indicated by 4 in FIG. 2 and an ordinary comparator circuit.

On the control circuit 5:

this circuit includes a program control circuit 5*a*, a count discriminating register 5*b*, and OR circuit 5*c*, an AND circuit 5*d*, a re-counting memory circuit 5*e*, a dispensing instruction memory circuit 5*f*, a try number memory circuit 5*g* and an alarm memory circuit 5*h*.

On the counter 6:

this is designated only by 6 in FIG. 2, too, and may be a usual counter.

On the cash dispensing and collecting mechanism control circuit 7 and the cash dispensing and collecting mechanism 8:

they are designated generally by 78 and will hereinafter be referred to as a cash dispensing and collecting section, which will be described in detail later on.

Next, the operation of the apparatus will be described more in detail.

At first, a signal indicative of the amount of money requested to be paid which is introduced by an operator, for example, a customer by some means, or a signal indicative of the amount to be paid which is instructed from a central processing unit, is stored in the register 3.

The aforesaid register 3 is a common buffer memory circuit which has stored therein the signal indicative of the amount to be withdrawn and other various data. Accordingly, the signals are applied from the register 3 to the program control circuit 5*a* and the signal indicative of the amount of money to be withdrawn is transferred to the register 2*a*.

The register 2*a* stores therein the amount of money in a monetary unit, for example, on the order of a hundred thousand yen, on the order of a ten thousand yen, on the order of a thousand yen, etc. Under the control of the program control circuit 5*a*, the register 2*a* applies, for example, a signal indicative of the number of bills to be paid to the register 1*a* through the AND circuit 2*b*.

When the signal indicative of the number of bills to be paid is set in the register 1*a*, the AND circuit 2*b* is closed by the control of the program control circuit 5*a* and, at the same time, the counting start memory circuit 2*c* is similarly set by the instruction from the program control circuit 5*a* and applies a counting start instructing signal to the control circuit 1*e* of the cash counting section 1.

The control circuit 1*e* applies the counting start instructing signal to the register 1*a*. The register 1*a* converts the signal indicative of the number of bills to be paid, stored therein, into a mechanical pulse and applies it to the counting mechanism 1*f* and, at the same time, similarly applies the signal indicative of the number of bills to be paid to the comparator circuit 1*b*.

The counting mechanism 1*f* counts the number of bills and, at the same time, checks the length, thickness, light transmission factor and the like of each bill. At every counting of each bill, a signal is applied to the counters 1*c* and 6. The results of checking of the length, thickness, light transmission factor and the like of each bill are supplied to the check memory circuit 1*d*.

The check memory circuit 1*d* is also supplied with the signal indicative of the number of bills to be paid, which is applied to the comparator circuit 1*b* from the register 1*a*, and the compared result of the bill counted content, which is applied to the comparator circuit 1*b* from the counter 1*c*.

The output from the check memory circuit 1*d*, that is, an OK (okay) or NG (no good) signal, is applied to the OR circuit 5*c*.

On the other hand, the count content of the counter 6 is applied to the comparator circuit 4 through the AND circuit 9′ and, in the comparator circuit 4, the count content of the counter 6 and the signal indicative of the number of bills to be paid, derived from the register 2*a*, are compared with each other and, as a result of this, an OK or NG signal is applied to the OR circuit 5*c*. In this manner, the number of bills to be paid is checked not only in the cash counting section 1 but also outside thereof. The AND circuit 9′ is opened i.e., disabled by a counting termination signal which is derived from the control circuit upon completion of counting by the cash counting section 1. Further, the counting termination signal serves to reset the counting start memory circuit 2*c*, too.

Where the OK signal is derived from the OR circuit 5*c*, the count discriminating register 5*b* which is, for example, a flip-flop circuit, is actuated by the signal in an OK mode of operation to set the dispensing instruction memory circuit 5*f*. The dispensing instruction mamory circuit 5*f* applies a dispensing instruction signal to the cash dispensing and collecting section 78.

The cash dispensing and collecting section 78 performs an operation for paying cash to a customer. This will be described in detail later on.

After cash is dispensed, a dispensing termination signal is derived from the cash dispensing and collecting section 78 to thereby reset the dispensing instruction memory circuit 5*f* and, at the same time, the dispensing termination signal is also applied to the program control circuit 5*a*, thus completing the cash dispensing operation.

On the other hand, where the NG signal is derived from the OR circuit 5*c*, the following operations are achieved. Namely, the count discriminating register 5*b* is actuated in the NG mode of operation and the one part of the output from the register 5*b* is applied to the try number memory circuit 5*g* and the other part is applied to the AND circuit 5*d*.

Where the number of NG signals input to the try number memory circuit 5*g* does not reach a predetermined number, for example, *n*times, that is, up to ($n$−1) times, the first (i.e., "($n$−1") output from the circuit 5*g* is applied to the AND circuit 5*d* to set the re-counting memory circuit 5*e*. Where the number of times the NG signal has been input, as stored in the try number memory circuit 5*g*, has reached the *n* times, instead, the second (i.e., "*n*") output from the circuit 5*g* is applied to the alarm memory circuit 5*h* to set it.

When the re-counting memory circuit 5*e* is set, the rejecting instruction signal derived therefrom is applied to the cash dispensing and collecting section 78, by which, for example, bills erroneously counted are collected, that is, cancelled, in the apparatus.

Upon completion of such rejecting operation, a reject termination signal is derived from the cash dispensing and collecting section 78 and applied to the re-counting memory circuit 5*e*. The re-counting memory circuit 5*e* derives therefrom a re-counting instruction signal, which is applied to the counting start memory circuit 2*c*. The counting start memory circuit 2*c* derives therefrom the counting start instruction signal again, thereby performing the cash dispensing operation described above.

As described above, where the alarm memory circuit 5*h* is set, a signal is applied therefrom to the program control circuit 5*a*, whereby the operation of the whole apparatus is stopped and, at the same time, a warning indication is provided or a warning is given.

In the foregoing, the counting start instruction is given after the signal indicative of the number of bills to be paid is transferred from the register 2*a* to the register 1*a*. However, it is also possible to transfer the signal indicative of the number of bills to be paid after applying the signal from the program control circuit 5*a* to the counting start memory circuit 2*c*, and the timing relationships therefor can also be set at will by the control of the program control circuit 5*a*.

The foregoing has described the apparatus shown in FIG. 2, the principal parts of which will hereinbelow be described more in detail.

Figure 3:
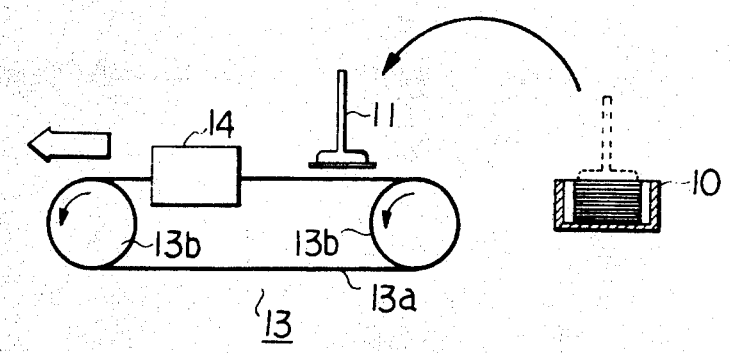
FIG. 3 is a schematic diagram, for explaining one part of a mechanism in a cash counting section.

FIG. 3 schematically illustrates one part of the mechanism of the cash counting section 1 depicted in FIG. 2.

In FIG. 3, reference numeral 10 indicates a bill container; 11 designates a bill selector or pick-up device, 12 identifies bills; 13 denotes generally a bill transfer device; 13*a* represents a belt; 13*b* shows rollers; and 14 refers to a detector.

In the above mechanism, the bill container 10 contains therein the bills 12. In the case where a plurality of kinds of bills are required, a plurality of bill containers are necessary. The bills 12 in the bill container 10 are brought one by one by the bill selector 11 to the bill transfer device 13.

The bill selector 11 selects the bills 12 one by one by a vacuum pressure in known manner and brings a required number of bills to the transfer device 13. On the transfer device 13, the bills 12 are sequentially brought to the detector 14, which detects the length, thickness and light transmission factor of each bill 12 to check whether the bills are transferred one by one. Where abnormality is found, the detector 14 produces an abnormality signal. Further, the detector 14 generates a pulse upon counting of each of the bills being transferred. One example of such a cash counting section 1 is disclosed in the U.S. Pat. No. 3,760,158 issued to James Whitehead et al.

Figure 4:
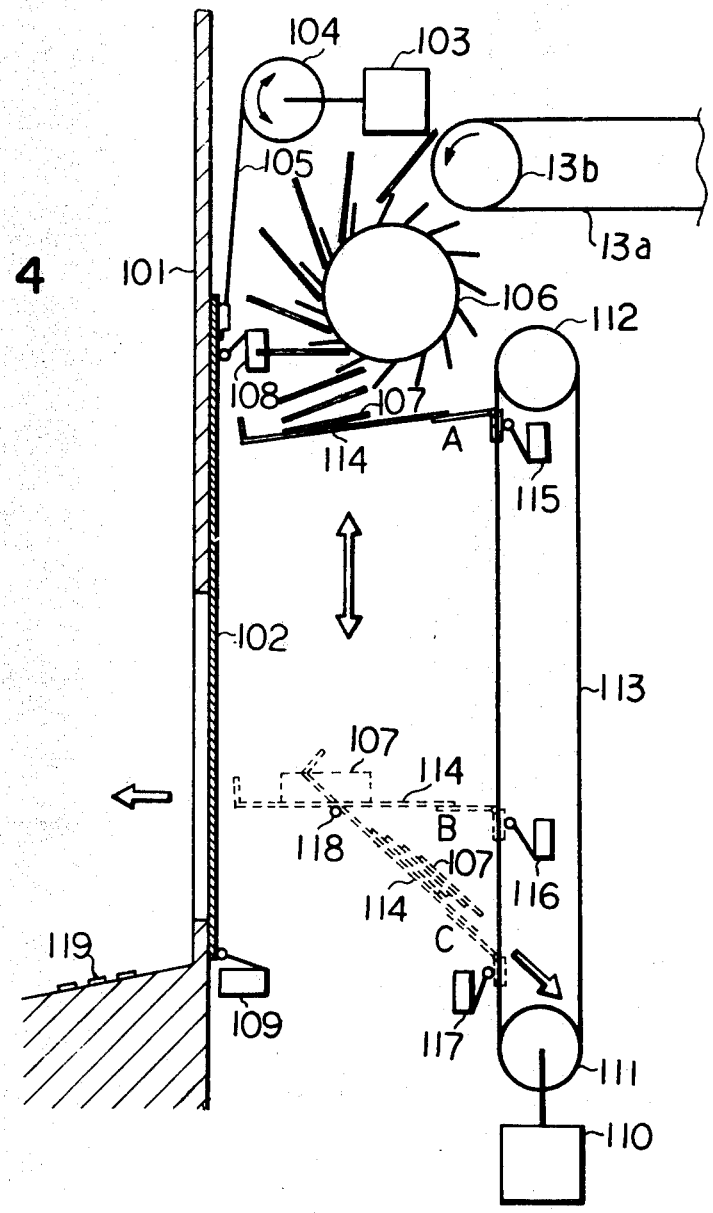
FIG. 4 is a schematic diagram, for explaining one part of a mechanism included in a cash dispensing and collecting section shown in FIG. 2.

The bills counted as described above are brought to a cash outlet of the apparatus or collected into the apparatus by means of the mechanism depicted in FIG. 4. This mechanism is included in the cash dispensing and collecting section 78 shown in FIG. 2.

in FIG. 4, reference numeral 101 identifies a panel; 102 designates a door; 103 denotes a motor for opening and shutting the door 102; 104 indicates a pulley driven by the motor 103; 105 represents a belt stretched between the door 102 and the pulley 104; 106 shows a rotary vane wheel; 107 refers to cash, i.e. a bill of a desired denomination; 108 indicates a limit switch for detecting the upper limit of the door 102; 109 designates a limit switch for detecting the lower limit of the door 102; 110 identifies a motor; 111 represents a pulley driven by the motor 110; 112 refers to a pulley which is a companion to the pulley 111; 113 shows a belt bridged between the pulleys 111 and 112; 114 designates a cash receptacle mounted on the belt 113; 115 identifies a limit switch for detecting the uppermost position of the cash receptacle; 116 indicates a limit switch for detecting the position at which the cash in the cash receptacle 114 can be taken out therefrom; 117 designates a limit switch for detecting the completion of rejection; 118 denotes a stopper; and 119 represents an actuating panel.

The following operations will be sequentially described on the assumption that the mechanism is at the stage of dispensing cash.

1. The cash receptacle 114 is at the position indicated by A and receives a required number of bills 107 from the cash counter such as depicted in FIG. 3, through the transfer device 13 and the rotary vane wheel 106.

2. When the required number of bills 107 has been counted, the motor 110 operates to drive the belt 113 to bring the cash receptacle 114 down to the position indicated by B. Whether the cash receptacle 114 has been brought to the predetermined position or not is detected by the operation of the switch 116.

3. The door 102 is opened by forward rotation of the motor 103 so that a customer may take out the cash (i.e., bills) 107.

4. When the door 102 has been opened, the customer reaches out his hand for the cash 107 in the cash receptacle 114.

5. After the cash 107 has been taken out, the motor 103 rotates in the reverse direction to shut the door and, at the same time, the motor 110 rotates in the reverse direction to bring the cash receptacle 114 up to the position A for subsequent operation.

The above operations are achieved in normal case. In an abnormal case, the following operations are carried out.

(A) In the case of the cash counter having erroneously counted:

1.' The cash receptacle 114 having received the cash 107 from the cash counter is brought by the belt 113 to the position indicated by C, where the cash 107 is removed from the cash receptacle 114 in the direction indicated by the arrow. The position of the cash receptacle 114, indicated by C, is detected by the rejecting completion detecting limit switch 117.

2.' Upon completion of removal of the cash 107 from the cash receptacle 114, the motor 110 is reversed to drive the belt 113 to return the cash receptacle 114 to the position indicated by A.

B. In the case where the customer does not take out the cash 107 although the cash can be taken out from the cash receptacle 114:

1.'' The cash receptacle 114 is brought from the position B to the position C to eject the cash 107 from the cash receptacle 114.

2.'' Then, the motor 110 is reversed to drive the belt 113 to return the cash receptacle 114 to the position A.

The cash dispenser provided with such a cash dispensing mechanism is sufficient when installed indoors but is not suitable for use outdoors.

The reason therefor is that since the cash dispenser is naturally embedded in the wall of a building when it is installed outdoors, the presence of the wall inevitably makes it necessary to carry cash not only in a vertical direction but also in a horizontal direction.

Figure 5:
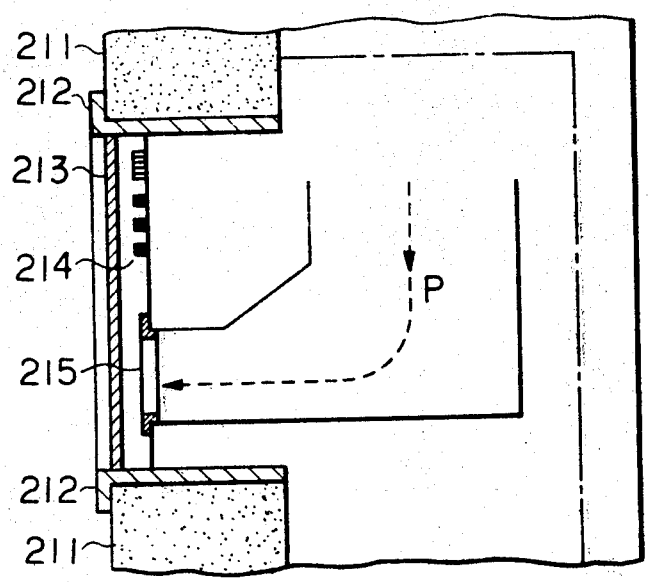

FIG. 5 is a schematic side view, partly cut away, showing the cash dispenser embedded in a wall.

In FIG. 5, reference numeral 211 indicates, for example, the wall of a building; 212 designates a frame disposed in an opening formed in the wall 211; 213 identifies a shutter; 214 dentoes an actuating panel; and 215 represents a cash dispensing outlet.

With the cash dispenser of such a construction, only by bringing down the cash from above as in FIG. 4, the cash cannot be brought to the cash taking-out position because of the wall 211. It is necessary to carry the cash to the neighborhood of the cash dispensing outlet 215 via the path such as indicated by the arrow P.

To this end, it is possible to employ a belt capable of carrying an article in any desired direction by selecting the arrangement of the belt but, in this case, the problem is in what condition cash is finally presented before a customer.

It is preferred that cash is presented before the customer while being pressed by appropriate clamping means lest it should be blown away by the wind and that the customer can easily remove the clamp to take out the cash.

Figure 6:
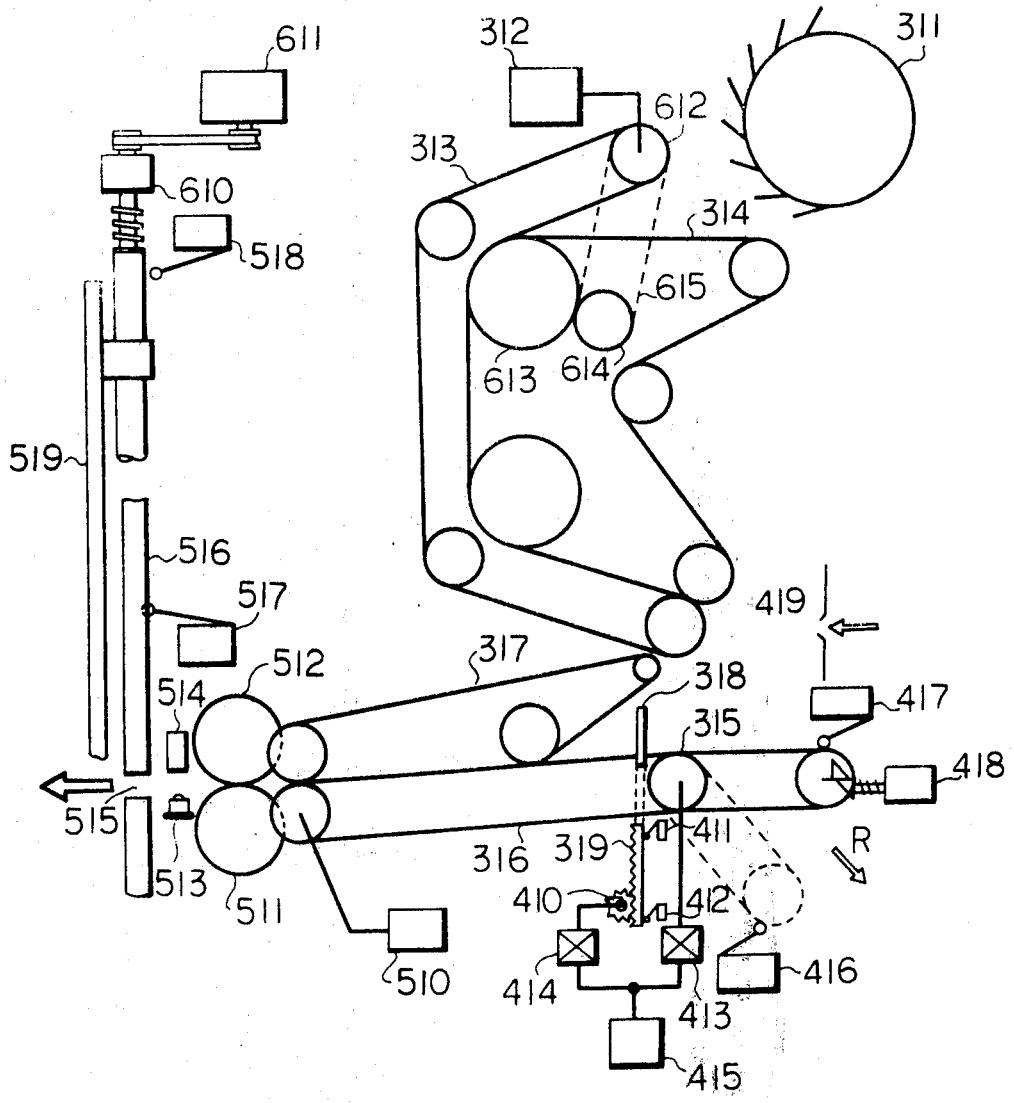
FIG. 6 is a schematic diagram, for explaining the mechanism of one example of this invention.

This problem can be solved by the employment of a mechanism illustrated in FIGS. 6 to 8.

In FIG. 6, reference numeral 311 indicates a rotary vane wheel; 312 designates a motor; 313 identifies a first belt; 314 represents a second belt; 315 denotes a third belt; 316 shows a fourth belt; 317 refers to a fifth belt; 318 indicates a stopper for putting bills in order; 319 designates a rack coupled with the stopper 318; 410 identifies a pinion meshed with the rack 319; 411 represents a limit switch for detecting the upper limit of the rack 319; 412 denotes a limit switch for detecting the lower limit of the rack 319; 413 and 414 show electromagnetic clutches; 415 refers to a motor; 416 and 417 indicate third belt position detecting switches; 418 designates an electromagnetic plunger; 419 identifies an outlet for a magnetic card or a receipt; 510 represents a motor; 511 and 512 denote clamping rollers; 513 shows a light emissive element; 514 refers to a light receiving element; 515 indicates an outlet for cash or the like; 516 designates a shutter; 517 identifies a limit switch for detecting the lower limit of the shutter 516; 518 represents a limit switch for detecting the upper limit of the shutter 516; 519 denotes an outer door; 610 shows a torque limiter; 611 refers to a motor; 612, 613 and 614 indicate pulleys; and 615 designates a sixth belt.

FIG. 7 is a plan view showing the neighborhood of the clamping rollers 511 and 512, in which the same parts as those mentioned above with regard to FIG. 6 are identified by the same reference numerals and no detailed description will be repeated.

As clearly shown in FIG. 7, the belt 317 (and the belt 316) is not single but plural, and hence the pulleys are formed correspondingly. Each of the other belts may also be formed with a plurality of belts.

The clamping rollers 512 (and the rollers 511) are each disposed to partly lie between adjacent ones of the plurality of belts 316.

FIG. 8 shows, in perspective, the clamping rollers, the same parts as those described above in connection with FIG. 6 being designated by the same reference numerals. In FIG. 8, shafts 616 and 617 of the clamping rollers 511 and 512 are resiliently interconnected at both ends by means of springs 618. The cash carried by the belts 316 and 317 is automatically inserted between the clamping rollers 511 and 512.

Since the shafts 616 and 617 of the clamping rollers 511 and 512 are interconnected by the springs 618, the cash is clamped by the force of the springs 618.

In the apparatus depicted in FIG. 6, the cash dispensing operation is achieved in the following manner.

In normal case:

1. A required number of bills are counted by the cash counter (FIG. 3) and sequentially brought down by the rotary vane wheel 311 onto the belt 314 and piled up thereon.

2. Upon completion of the counting, the motor 312 is actuated and its power is transmitted to the belts 313 and 314 through an appropriate transmission mechanism. For example, the belt 313 is driven through the pulley 612 and the belt 314 is driven through the pulleys 612, 613 and 614 and the belt 615. Thus. the belts 313 and 314 are driven at the same speed.

3. The cash is carried first on the belt 314 and then brought down onto the belt 315 while being held between the belts 313 and 314.

4. Upon throwing down the cash onto the belt 315, the motor 312 is stopped, and hence the belts 313 and 314 are also stopped.

5. Then, the motor 510 is rotated to drive the belts 315 and 316, whereby the cash on the belt 315 runs against the stopper 318 and is put in order.

6. The motor 510 is stopped.

7. The motor 415 is rotated and, at the same time, the electromagnetic clutch 414 is turned on to drive the pinion 410, thereby bringing down the stopper 318 coupled with the rack 319.

8. When the rack 319 has been brougnt down to its lowermost position, that is, when the top of the stopper has lowered to be flush with or below the surface of the belt 316, the switch 412 is actuated to turn off the electromagnetic clutch 414 and, at the same time, the motor 415 is stopped.

9. The motor 510 is rotated.

10. The cash is brought towards the outlet 515 while being held between the belts 316 and 317, and carried between the rollers 511 and 512 and then between the light emissive element 513 and the light receiving element 514. Finally, the front end portion of the cash projects out from the outlet 515 but the rear end portion is still clamped between the rollers 511 and 512.

11. When a customer pulls out the cash partly projecting out from the outlet 515, a signal is generated by the light receiving element, thus completing all the operations.

In abnormal case (for example, erroneous bill counting, power suspension, power interruption, etc.):

1.′ The initial processes are identical with those (1) to (3) described above. Assume that the cash is placed on the belt 315.

2′ The motor 415 is rotated.

3′ The electromagnetic clutches 413 and 414 are turned on and, at the same time, the electromagnetic plunger 418 is turned on.

4.′ since the electromagnetic plunger 418 does not serve as a lock for holding the belt 315 at the position indicated by the solid line, the belt 315 is inclined by the electromagnetic clutch, 413 as indicated by the broken line.

5.′ The stopper 318 is also lowered so that its top may be flush with or below the surface of the belt 316.

6.′ The motor 510 is reversed to remove the cash from the belts 315 and 316 is a direction of the arrow R.

7.′ Upon removal of the cash, the motor 510 is stopped and, at the same time, the belt 315 and the stopper 318 are returned to their original positions by the motor 415 and the electromagnetic clutches 413 and 414.

The function of removing the cash by inclining the belt 315, described above, is very important.

For example, in the apparatus of FIG. 6, it appears possible to remove the cash by driving the belts 315 and 316 in a backward direction instead of inclining the belt 315. However, since a receipt producing mechanism, a mechanism for bringing a receipt made thereby or a card onto the belt 315 and like mechanisms are disposed in a complicated manner immediately at the back of the belt 315, that is, on the right-hand side of the figure, it is impossible to use such an arrangement that the cash is removed only by driving the belt 315 backward. Accordingly, the arrangement of inclining the belt 315 in a desired direction is of much utility.

Figure 9:
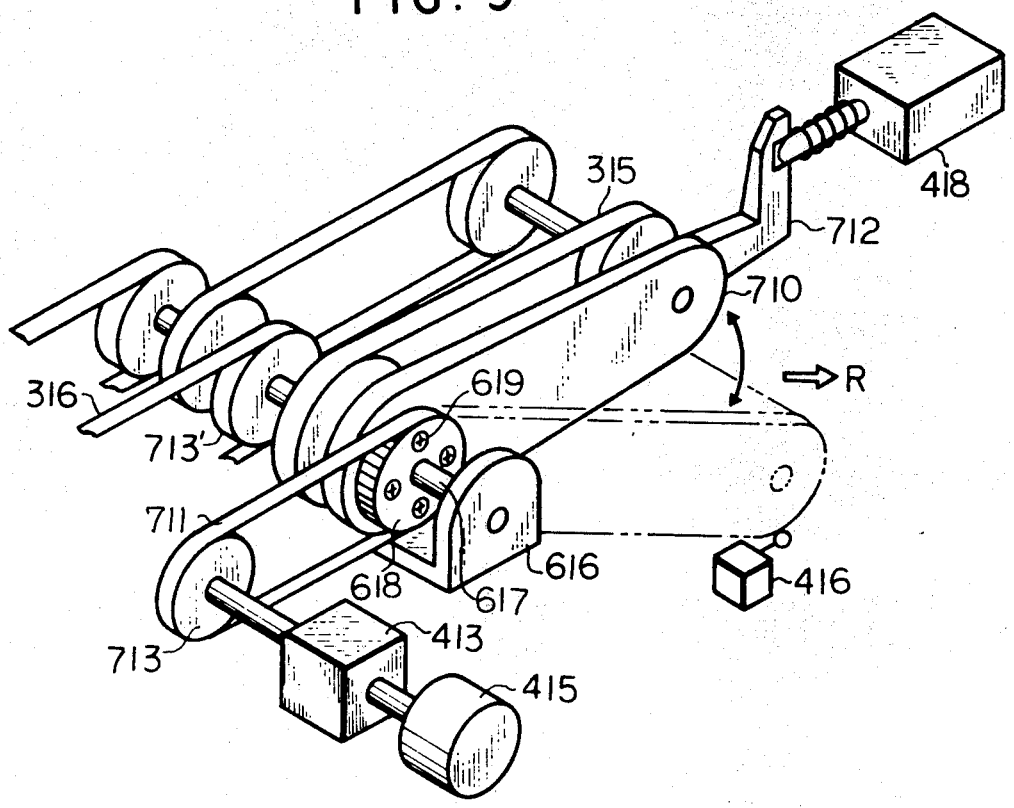
FIG. 9 is a perspective view illustrating the principal part of a rejecting mechanism.

Turning now to FIG. 9, the detailed construction and operation of the mechanism therefor will be further described. In FIG. 9, parts corresponding to those in FIG. 6 are indicated by the same reference numerals.

In FIG. 9, an angled bracket 616 carries a shaft 617 and an arm, which is journalled to the shaft 617, has a pulley 618 fixed thereto by means of screws 619. A belt 711 is bridged between the pulleys 618 and 713. The arm 710 has a projection 712 fixed thereto at one end and the other end of the projection 712 engages the electromagnetic plunger 418. The shaft 617 has affixed thereto pulleys 713′, which are rotatable relative to the angled bracket 616 and the pulley 618.

With such an arrangement, in the case of removing the cash, the electromagnetic plunger 418 is actuated first. When actuated, the electromagnetic plunger 418 is disengaged from the projection 712.

Then, the electromagnetic clutch 413 and the motor 415 are actuated and the power of the motor 415 is transmitted to the pulley 618 through the pulley 713 and the belt 711. Since the pulley 618 is fixed to the arm 710, the latter is inclined as indicated by dot-dash lines, and consequently the belt 315 is also inclined.

The inclination of the arm 710 is detected by the third belt position detecting switch 416. When the belt 315 has been lowered to its inclined position, the belts 315, 316 and 317 are driven by the motor 510 in a direction opposite to that in the normal mode of operation, by which the cash 107 is removed in the direction of the arrow R.

Upon completion of removal of the cash, the motor 415 is reversed to return the arm 710 to its initial position.

By the way, in the apparatus of FIG. 6, the stopper 318, which is moved up and down by the action of the rack 319 and the pinion 410, is provided in the travelling path of the belt 315. The function of the stopper 318 is very important. Namely, in the case where cash is carried by the elevator-like mechanism described previously with regard to FIG. 4, cash kept relatively in order can be presented before the customer. However, in the case of carrying cash by means of belts, if there is no mechanism for putting bills in proper order such as the stopper 318, bills cannot be carried to the outlet while being kept in proper order, so that the customer must pull out the bills again and again and, in some cases, he cannot pull out the bills. Therefore, the provision of the stopper 318 is of much utility.

Figure 10:
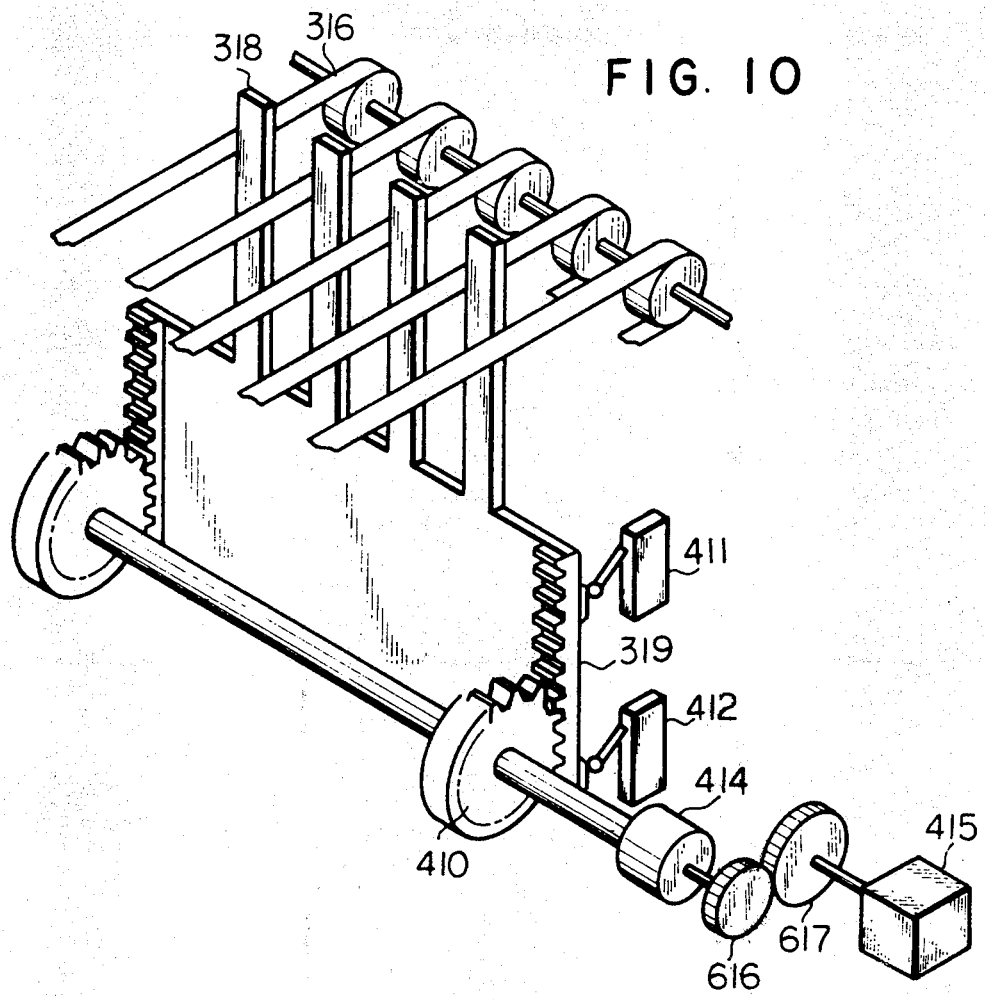
FIG. 10 is a perspective view showing the principal part of a mechanism for putting cash in proper order.

Referring now to FIG. 10, the construction and function of the stopper 318 will hereinbelow be described in detail. In FIG. 10, parts corresponding to those in FIG. 6 are marked with the same reference numerals and no detailed description will be repeated.

As seen from FIG. 10, the stopper 318 having a plurality of upward arms is disposed with the arms each projecting out from between adjacent ones of the plurality of belts 316. The lower portion of the stopper 318 has formed thereon the rack 319, which meshes with the pinion 410. The pinion 410 has connected thereto the electromagnetic clutch 414, which is connected to the motor 415 through gears 616 and 617.

On the opposite side from the rack 319, there are formed two projections at upper and lower positions of the rack 319 in a manner to make contact with the limit switches 411 and 412 respectively.

Next, the operation of the stopper 318 will be described. At first, the stopper 318 is positioned to project out from between the belts 316 and bills carried on the belts 316 run against the stopper 318 to be put in order.

After the bills are put in order, the electromagnetic clutch 414 and the motor 415 are actuated to drive the pinion 410 to bring down the stopper 318 to such a position that its top is flush with or below the surface of each belt 316. The lowering of the stopper 318 to the above position is detected by the limit switch 412.

After the bills are taken out from the cash dispensing outlet 515, the electromagnetic clutch 414 and the motor 415 are actuated to bring up the stopper 318 back to its original position. The return of the stopper 318 to its initial position is detected by the limit switch 411.

As described above, in abnormal cases, too, the stopper 318 is lowered but, in this case, after the bills are removed, the stopper 318 is brought back to its original position.

From the foregoing description, the present invention will be fully understood. It is a matter of course that this invention is not limited specifically to the foregoing examples but that many modifications and variations may be effected by adding known techniques. For example, it is apparent that this invention can be applied not only to bills but also to coins by some variations of the mechanisms used.

Numerous modifications and adaptations of the system of the invention will be apparent to those skilled in the art and thus it is intended by the appended claims to cover all such modifications and adaptations which fall within the true spirit and scope of the invention.

What is claimed is:

1. A cash dispensing system comprising:

cash container means for containing therein cash;

means for instructing the system as to the amount of cash to be dispensed;

cash counter means for taking out an amount of cash, as instructed, from said cash container means and counting the amount of cash so taken out;

cash transfer means for guiding said cash taken out from said cash container means along a cash transfer path to a cash outlet for dispensing thereof;

abnormality detector means for detecting an abnormality in said cash taken out from the cash container means and producing an abnormality detection output;

cash collecting means for collecting said cash taken out from said cash container in response to an abnormality detection output of said abnormality detector means;

counter means for counting the number of abnormality detection outputs of said abnormality detection outputs of said abnormality detector means; and means responsive to an abnormality detection output produced by said detector means for a given said instructed amount of cash to be dispensed, to activate said means for taking out and counting the said instructed amount of cash, to again take out and count the said instructed amount of cash when said count of said abnormality detection output counter means is less than a predetermined value, and for stopping the dispensing operations when the count of said abnormality detection output counter means reaches a predetermined value.

2. A cash dispensing system according to claim 1, wherein said cash transfer means comprises belts and actuating means for the belts, said belts being disposed to hold cash therebetween for transfer thereby when driven by said actuating means.

3. A cash dispensing system according to claim 1, further comprising means for engaging said cash transferred to said cash outlet for partially clamping said cash when presented to a customer.

4. A cash dispensing system according to claim 1, wherein said cash collecting means includes a belt and drive means thereof, and means for tilting said belt in response to said abnormality detection output to reject said cash carried on said belt.

5. A cash dispensing system according to claim 1, further comprising means for putting said cash in order, said means being disposed at a desired position along the cash transfer path of said cash transfer means.

6. A cash dispensing system according to claim 1, further comprising means for temporarily pooling therein said cash taken out by said cash counter means to smoothly collect said cash in accordance with the abnormality detection by said abnormality detector means.

7. A cash dispensing system according to claim 1 wherein said abnormality detection means includes means for comparing the said instructed amount of cash to be dispensed with the count value of said cash counter means representing the amount of cash taken out from said cash container means and producing an abnormality detection output when the said instructed amount and said count value differ.

8. A cash dispensing system according to claim 1 wherein said cash transfer means transfers said cash taken out from said cash container means to said cash outlet for dispensing thereof when said abnormality detector means does not produce an abnormality detection output.

9. A cash dispensing system comprising:
cash container means for containing cash therein as individual bills of at least one denomination;
means for instructing the system as to the amount of cash to be dispensed;
means for defining the number of bills of said at least one denomination corresponding to the said instructed amount of cash;
cash counter means for counting and taking out the said number of bills of said at least one denomination corresponding to the said instructed amount of cash from said cash container means;
cash transfer means for guiding said cash taken out from said cash container means along a cash transfer path to a cash outlet;
means for engaging said cash as transferred to said cash outlet, for partially clamping said cash when presented at said cash outlet for dispensing.

10. A cash dispensing system comprising:
cash container means for containing cash therein;
means for instructing the system as to the amount of cash to be dispensed;
cash counter means for counting and taking out an instructed amount of cash from said cash container means;
cash transfer means for guiding said cash taken out from said cash container means along a cash transfer path to a cash outlet;
means for engaging said cash as transferred to said cash outlet, for partially clamping said cash when presented at said cash outlet for dispensing; and
means for putting said cash in order, said means being disposed on the cash transfer path of said cash transfer means.

11. A cash dispensing system according to claim 9, wherein said engaging means comprises a pair of clamping rollers.

12. A cash dispensing system according to claim 9, further comprising means for detecting the removal of said cash as dispensed from said cash outlet.

13. A cash dispensing system comprising:
cash container means for containing therein cash;
means for instructing the system as to the amount of cash to be dispensed;
cash counter means for counting and taking out an instructed amount of cash from cash container means;
cash transfer means for guiding said cash taken out from said cash container means along a cash transfer path to a cash outlet;
means for engaging said cash transfered to said cash outlet for partially clamping said cash when presented to a customer;
abnormality detector means for detecting an abnormality in said cash taken out from the cash container means and producing an abnormality detection output;
cash collecting means for collecting said cash taken out from said cash container in response to an abnormality detection output,
counter means for counting the number of abnormality detection outputs of said abnormality detector means; and
means for stopping the dispensing operations when the said abnormality detection counter count is a predetermined value.

14. A system for dispensing an amount of cash in accordance with a number of bills of at least one denomination, comprising:
means for storing a supply of cash in accordance with bills of at least one denomination;
means for instructing the system as to the amount of cash to be dispensed;
means for determining the number of bills of said at least one denomination corresponding to the said amount of cash instructed to be dispensed;
means for taking the said number of bills of said at least one denomination from said cash container means in accordance with the said determined number corresponding to the amount of cash instructed to be dispensed;
transfer means for guiding said bills taken from said cash container means along a cash transfer path to a cash outlet for dispensing thereof;
means for detecting an abnormality in said bills taken from said cash container means and producing an abnormality detection output;
means for collecting said cash taken out from said cash container in response to an abnormality detection output of said detector means thereby to prevent transfer of said bills to said cash outlet for dispensing thereof;
means for counting said abnormality detection outputs; and
means for activating said taking out means, to again take out the said number of bills corresponding to the said instructed amount of cash to be dispensed in response to an abnormality detection output, when the count of said abnormality detection output counter means is less than a predetermined value, and to stop the dispensing operations of said system when the count of said abnormality detection counter means reaches said predetermined value.

15. A cash dispensing system as recited in claim 14 wherein said detector means includes means for counting the number of said bills of said at least one denomination as taken out from said cash container means and means for comparing the said count thereof with the number of bills of the corresponding at least one denomination corresponding to the amount of cash to be dispensed and producing an abnormality detection output when said number and said count differ.

16. A cash dispensing system as recited in claim 14, wherein said abnormality detection means comprises means for detecting characteristics of each bill and producing an abnormality detection output when an abnormality in any of the said characteristics is detected.

17. A cash dispensing system as recited in claim 14, further comprising:
means for storing the amount of cash instructed to be dispensed;
means for converting the stored said amount of cash to a corresponding number of bills of at least one denomination and providing as an output the said number of bills;

a further means for storing the said converted number of bills;

means responsive to said cash value store and bill converting means storing said number of bills to enable said further means to be set to and store said number of bills;

said detector means producing a detector count output for each bill taken from said container means;

first and second counter means each receiving and accumulating a count in accordance with said detector count output;

first comparison means for comparing the count of said first counter with said converted number of bills corresponding to the amount of cash instructed to be dispensed and stored in said converting and storing means and producing an approval signal or an error signal in response to the said number and the said count being the same or different, respectively;

second comparison means for comparing the said converted number of bills stored in said further storing means with the count of said second counter means and producing an approval or an error signal when said number and said count are the same or different, respectively, control means for initiating said counting operations of said first and second counters and for enabling said comparison means when the said converted number of bills has been taken from said container means; and means for storing an indication of the approval or error signals from said comparison means.

18. A cash dispensing system as recited in claim 17, further comprising:

means for enabling the dispensing of said bills in accordance with the amount of cash to be dispensed in response to the storage of the approval signal by said approval or error signal storing means, and means for resetting said approval or error storing means upon completion of dispensing of the number of bills corresponding to the amount of cash instructed to be dispensed.

19. A cash dispensing system as recited in claim 17. further comprising:

means for storing a predetermined number representing a maximum number of permissible error outputs and corresponding dispensing operations;

gating means responsive to each error output to enable the said means for taking out the said number of bills of at least a given denomination in accordance with the said number as stored in said further memory means, and means for accumulating the number of said error signals to enable said gating means for each successive error signal of a total less than said predetermined number and to disable said gating means when said number of error signals equals said predetermined number.

20. A cash dispensing system as recited in claim 19, wherein said enabling means is responsive to completion of operation of said collecting means for enabling said means to take out said bills in response to each said error signal.

21. A cash dispensing system as recited in claim 19, wherein there is further provided alarm means responsive to said number of error signals equaling said predetermined number thereof to disable said dispensing system and produce an alarm indicative thereof.

* * * * *

UNITED STATES PATENT AND TRADEMARK OFFICE

CERTIFICATE OF CORRECTION

PATENT NO. : 3,965,913

DATED : June 29, 1976

INVENTOR(S) : Katsuyuki Tokura, Shuichi Maeda, Kenji Yoichizono and Hiroshi Asami It is certified that error appears in the above-identified patent and that said Letters Patent are hereby corrected as shown below:

Column 5, line 39, change "circuite" to --circuit le--.

Column 5, line 48, change "mamory" to --memory--.

Signed and Sealed this

Fourteenth Day of September 1976

[SEAL]

*Attest:*

RUTH C. MASON
*Attesting Officer*

C. MARSHALL DANN
*Commissioner of Patents and Trademarks*